United States Patent [19]

Wang

[11] Patent Number: 5,008,784

[45] Date of Patent: Apr. 16, 1991

[54] LIGHTING EQUIPMENT FOR A KEY RING

[76] Inventor: Howard Wang, No. 7, Alley 14, Lane 64, Ching Ping Rd., Chung Ho City, Taipei Hsien, Taiwan

[21] Appl. No.: 524,573

[22] Filed: May 17, 1990

[51] Int. Cl.[5] ..... F21V 33/00

[52] U.S. Cl. ..... 362/116; 362/206; 200/60

[58] Field of Search ..... 302/109, 116, 202, 203, 302/205, 206; 200/60

[56] References Cited

U.S. PATENT DOCUMENTS

| | | | |
|---|---|---|---|
| 2,180,228 | 11/1939 | Florman | 362/203 |
| 2,249,689 | 7/1941 | Gelardin | 362/203 |
| 4,220,985 | 9/1980 | Hukuba | 362/203 |
| 4,281,368 | 7/1981 | Humbert | 362/205 |
| 4,327,401 | 4/1982 | Siiberg | 362/205 |

FOREIGN PATENT DOCUMENTS

| | | | |
|---|---|---|---|
| 342342 | 1/1931 | United Kingdom | 362/205 |
| 533011 | 2/1941 | United Kingdom | 362/202 |
| 534202 | 2/1941 | United Kingdom | 362/203 |

*Primary Examiner*—Stephen F. Husar
*Assistant Examiner*—D. M. Cox
*Attorney, Agent, or Firm*—Morton J. Rosenberg; David I. Klein

[57] ABSTRACT

A lighting equipment includes a cylindrical tube having a profile formed in a bottom. The profile has a pair of lower grooves and a pair of higher grooves. A barrel, a spring, a cell and a braket are received in the cylindrical tube. A rod is coupled to the bracket. A pin is laterally provided on the rod. The pin is actuated to follow the profile so that the pin is laid in either the upper grooves or the lower grooves. A center electrode of the cell is actuated either to contact or to be separated from a prong of a light bulb in order to turn on or turn off the light bulb.

2 Claims, 4 Drawing Sheets

LIGHTING EQUIPMENT FOR A KEY RING

BACKGROUND OF THE INVENTION

The present invention relates to a lighting equipment, and more particularly to a lighting equipment for a key ring.

Key rings are designed for supporting or stringing keys. It is usually hard to find the key holes in the dark in order that keys may be readily inserted into the key holes. Therefore, a key ring having a lighting equipment is highly desired.

SUMMARY OF THE INVENTION

The present invention is to provide a lighting equipment for a key ring, the key hole may be lighted by the lighting equipment so that the key which is strung on the key ring can be easily inserted into the key hole.

In accordance with one aspect of the present invention, there is provided a lighting equipment which is coupled to a key ring. The lighting equipment includes a cylindrical tube having a profile formed in a bottom. The profile has a pair of lower grooves and a pair of higher grooves. A lower end of a barrel is received in the cylindrical tube. A ring element is provided around the upper end of the barrel and contacts an upper end of the cylindrical tube. A light bulb which has two prongs is received in the upper end of the barrel, one of the prongs is connected to the ring element, and a resilient leg is coupled to another prong. A spring and a cell is received in the lower end of the barrel. A bracket is provided between the barrel and the cylindrical tube, the bracket and the cell are biased downward by the spring. A rod extends through a center of the bottom of the cylindrical tube and is coupled to the bracket. A pin is laterally provided on the rod. The key ring is strung on a lower end of the rod. The pin is actuated to follow the profile so that the pin is laid in either the upper grooves or the lower grooves and so that a center electrode of an uppermost cell is actuated either to contact or to be separated from the resilient leg in order to turn on or turn off the light bulb.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
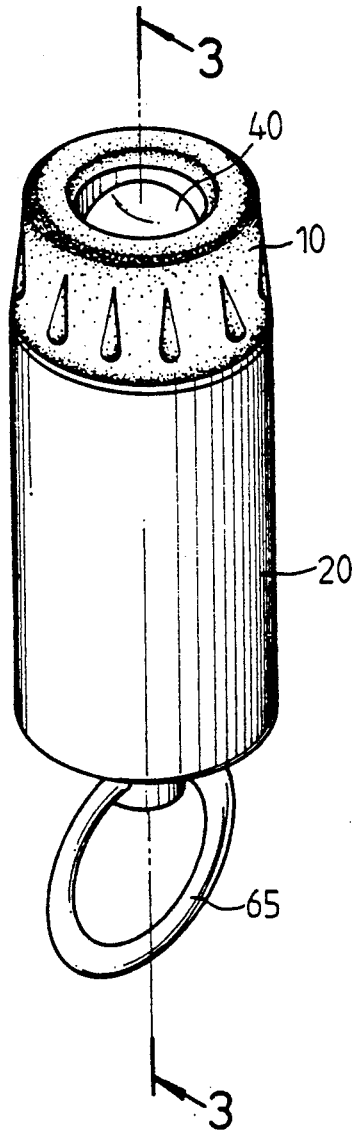
FIG. 1 is a perspective view of a lighting equipment for a key ring in accordance with the present invention.
Figure 2:
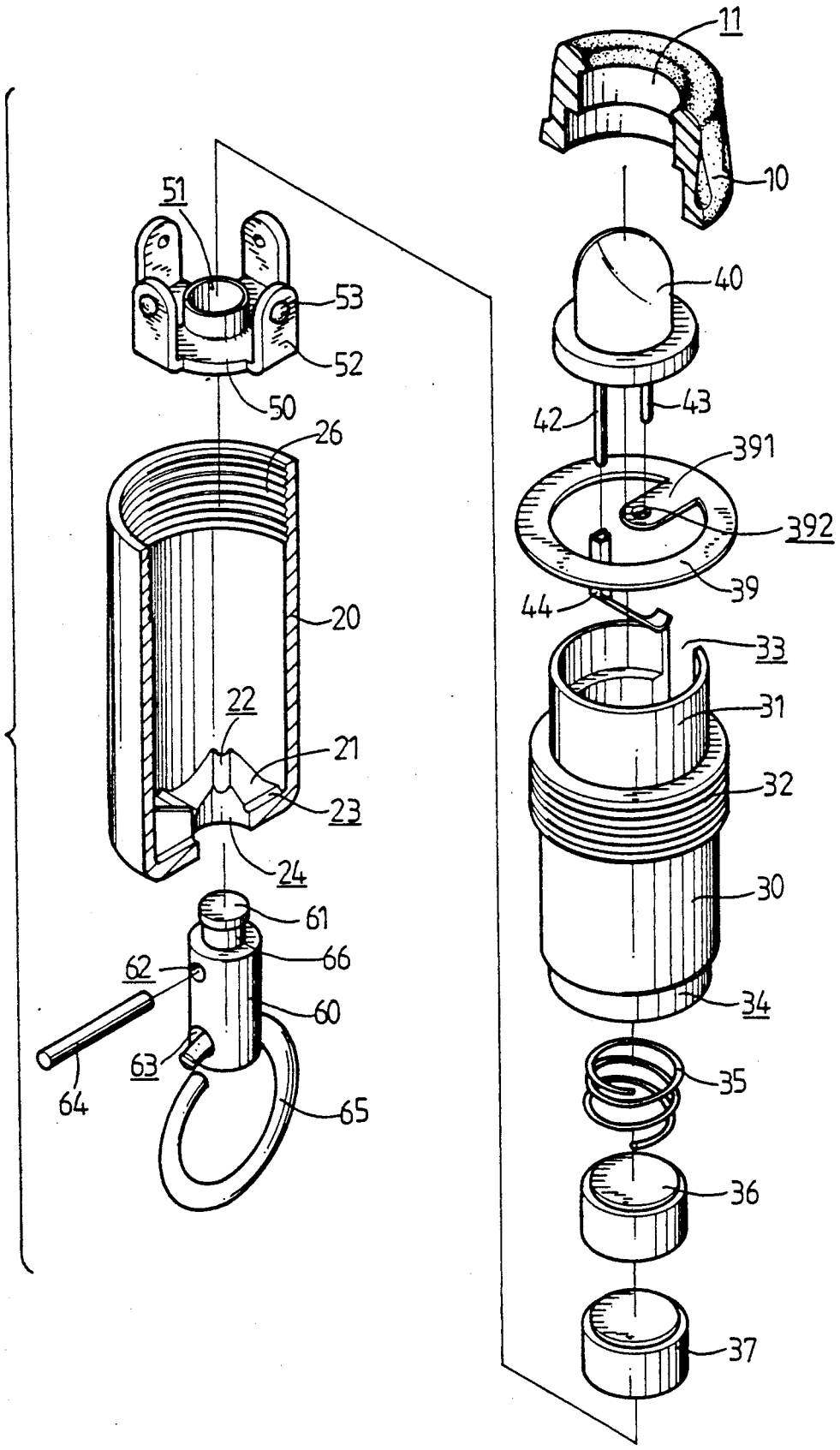
FIG. 2 is an exploded view of the lighting equipment.
Figure 3:
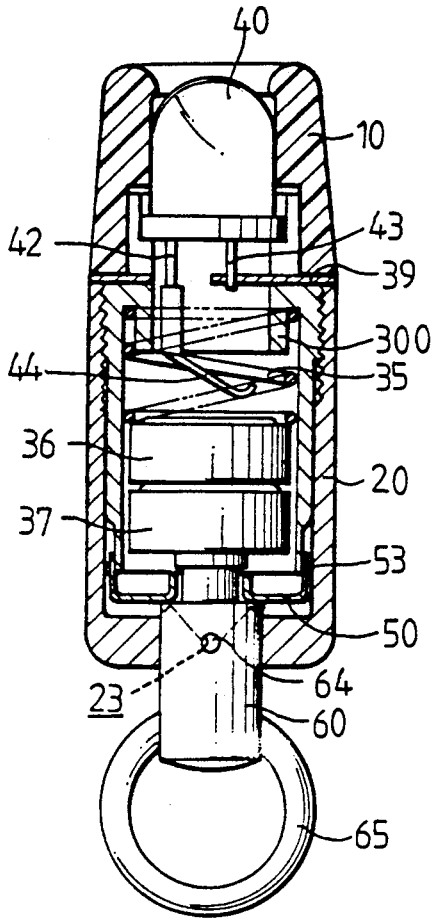
FIG. 3 is a cross sectional view of the lighting equipment taken along lines 3—3 of FIG. 1.
Figure 4:
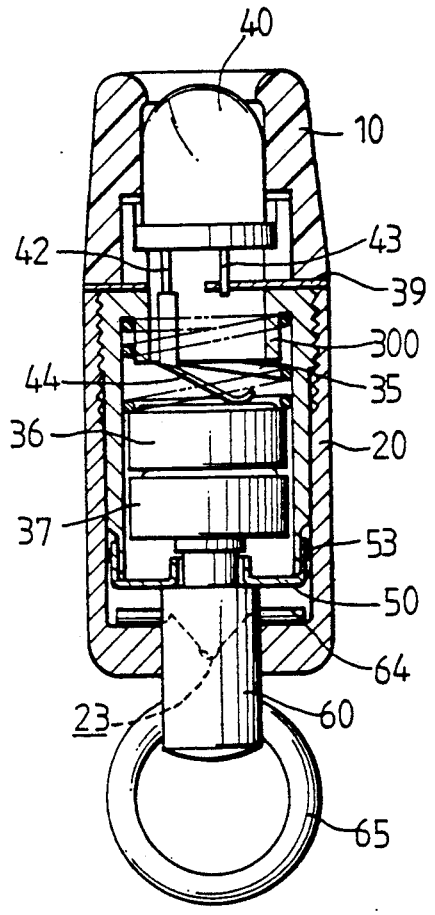
FIG. 4 is a cross sectional view of the lighting equipment, similar to FIG. 3, illustrating a working position of the lighting equipment.

Referring to the drawings and initially to FIGS. 1, 2 and 3, a lighting equipment for a key ring in accordance with the present invention comprises generally a cylindrical tube 20, a face cap 10 provided on an upper end of the lighting equipment, and a key ring 65 coupled to a lower end of the lighting equipment.

The cylindrical tube 20 has a profile 21 and an aperture 24 formed in a lower end thereof. The profile 21 fluctuates with two pairs of higher grooves 22 and two pairs of lower grooves 23 alternatively formed thereon. An inner thread 26 is formed in an upper end of the cylindrical tube 20. A barrel 30 is substantially cylindrical with a reduced diameter portion 31 and an outer thread 32 formed on an upper end and an annular recess 34 formed on a lower end thereof. The inner thread 26 of the cylindrical tube 20 is threadedly engaged with the outer thread 32 of the barrel 30. A notch 33 is vertically formed in the reduced diameter portion 31. A ring element 39 has a tongue 391 extending toward a center thereof and surrounds the reduced diameter portion 31. The tongue 391 which has a hole 392 formed in a free end thereof extends through the notch 33 into an interior of the reduced diameter portion 31. A light bulb 40 which has a long prong 42 and a short prong 43 is received in the reduced diameter portion 31. The short prong 43 is fixed in the hole 392 by such as soldering so that the short prong 43 is electrically connected to the ring element 39. A resilient leg 44 is coupled to the long prong 42. The face cap 10 is force-fitted on the reduced diameter portion 31. An opening 11 is formed in an upper end of the face cap 10 so that a light from the light bulb 40 can be emitted through the opening 11. The ring element 39 electrically contacts the upper end of the cylindrical tube 20.

A spring 35 and two cells 36, 37 are received in the barrel 30. As is best shown in FIG. 3, an annular flange 300 is formed in a middle portion of the barrel 30 so that an upper end of the spring 35 is engaged between the annular flange 300 and the barrel 30. A bracket 50 which has a center hole 51 has four equally spaced lugs 52 vertically provided on a peripheral edge thereof. A protrusion 53 is formed on an upper and outer end of each lug 52. The lugs 52 of the bracket 50 surround the annular recess 34 of the barrel 30. The protrusions 53 of the bracket 50 electrically contact the inner surface of the cylindrical tube 20. The spring 35, the cells 36, 37 and the bracket 50 are biased downward by the spring 35.

A rod 60 has two holes 62, 63 laterally formed therein for slidably receiving a pin 64 and the key ring 65 respectively. A reduced diameter portion 66 which has a disc 61 provided on an upper end thereof is formed on an upper end of the rod 60. The reduced diameter portion 66 of the rod 60 is engaged in the center hole 51 of the bracket 50. The disc 61 of the rod 60 is electrically connected to the case electrode of the cell 37. The pin 64 is laid on the profile 21 of the cylindrical tube 20 and is actuated to move relatively along the profile 21 by a rotation of the key ring 65. The rod 60 is also biased downward by the spring 35 so that both ends of the pin 64 are rested either in the lower grooves 23 or the higher grooves 22 of the profile 21.

As shown in FIG. 3, when both ends of the pin 64 are laid in the lower grooves 23, the cells 36, 37, the bracket 50 and the rod 60 are biased downward by the spring 35 so that the resilient leg 44 is separated from the cell 36. The electrical circuit of the lighting equipment is disconnected so that the bulb is off. The electrical circuit of the lighting equipment runs through the short prong 43, the ring element 39, the cylindrical tube 20, the bracket 50, the rod 60, the cells 36, 37, and the long prong 42 and the resilient leg 44.

If it is desired to turn on the lighting equipment, it is only required to rotate the key ring 65. The pin 64 is actuated to move along the profile 21 until both ends of the pin 64 are laid in the higher grooves 22. The cells 36, 37 are pushed upwards so that the center electrode of the cell 36 electrically contacts the resilient leg 44. The electrical circuit of the lighting equipment is connected so that the light bulb 40 is on.

If it is desired to turn off the lighting equipment, it is only required to rotate the key ring 65 again until both ends of the pin 64 are laid in the lower grooves 23. The cells 36, 37 are pushed downwards so that the resilient leg 44 is separated from the center electrode of the cell 36. The electrical circuit of the lighting equipment is disconnected again so that the light bulb 40 is off again.

Accordingly, the lighting equipment for a key ring in accordance with the present invention can be easily turn on and turn off.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighting equipment for a key ring comprising a cylindrical tube having a profile formed in a bottom thereof, said profile having a pair of lower grooves and a pair of higher grooves; a barrel being substantially received in said cylindrical tube with an upper end extending beyond said cylindrical tube, a notch being vertically formed in said upper end of said barrel; a ring element being provided around said upper end of said barrel and contacting an upper end of said cylindrical tube, a tongue being integrally formed on said ring element and extends toward a center thereof, said tongue extending through said notch toward a center of said barrel; a light bulb which has two prongs being received in said upper end of said barrel, one of said prongs being integrally fixed to said tongue so that said one prong is electrically connected to said tongue, a resilient leg being coupled to an other prong; a spring and at least one cell being received in a lower end of said barrel; a bracket being provided between said barrel and said cylindrical tube, said bracket and said cell being biased downward by said spring; a rod extending through a center of said bottom of said cylindrical tube and being coupled to said bracket; a pin being laterally provided on said rod; and said key ring being strung on a lower end of said rod; and said pin being actuated to follow said profile so that both ends of said pin are laid in either said upper grooves or said lower grooves and so that a center electrode of an uppermost cell is actuated either to contact or to be separated from said resilient leg in order to turn on or turn off said light bulb.

2. A lighting equipment for a key ring comprising a cylindrical tube having a profile formed in a bottom thereof, said profile having a pair of lower grooves and a pair of higher grooves; a barrel being substantially received in said cylindrical tube with an upper end extending beyond said cylindrical tube, an annular recess being formed on a lower end of said barrel; a ring element being provided around said upper end of said barrel and contacting an upper end of said cylindrical tube; a light bulb which has two prongs being received in said upper end of said barrel, one of said prongs being connected to said ring element, a resilient leg being coupled to an other prong; a spring and at least one cell being received in a lower end of said barrel; a bracket being provided between said barrel and said cylindrical tube, said bracket and said cell being biased downward by said spring, said bracket having four equally spaced lugs vertically provided on a peripheral edge thereof, a protrusion being formed on an upper and outer end of each said lug, said lugs holding said annular recess of said barrel, said protrusions electrically contacting an inner surface of said cylindrical tube; a rod extending through a center of said bottom of said cylindrical tube and being coupled to said bracket; a pin being laterally provided on said rod; and said key ring being strung on a lower end of said rod; and said pin being actuated to follow said profile so that both ends of said pin are laid in either said upper grooves or said lower grooves and so that a center electrode of an uppermost cell is actuated either to contact or to be separated from said resilient leg in order to turn on or turn off said light bulb.

* * * * *